US007703624B2

(12) United States Patent
McEldowney et al.

(10) Patent No.: US 7,703,624 B2
(45) Date of Patent: Apr. 27, 2010

(54) FLEXIBLE TAB, TOOLING FOR THE MANUFACTURE OF THE FLEXIBLE TAB AND METHOD OF MANUFACTURING THE FLEXIBLE TAB

(75) Inventors: Carl McEldowney, Ansonia, OH (US); Craig McEldowney, Russia, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 1287 days.

(21) Appl. No.: 11/207,046

(22) Filed: Aug. 18, 2005

(65) Prior Publication Data

US 2007/0039961 A1 Feb. 22, 2007

(51) Int. Cl.
*B65D 17/34* (2006.01)

(52) U.S. Cl. ..... 220/269; 220/270; 220/906; 220/268

(58) Field of Classification Search ..... 220/269, 220/906, 270, 271, 268
See application file for complete search history.

(56) References Cited

U.S. PATENT DOCUMENTS

| | | | | | |
|---|---|---|---|---|---|
| 3,499,573 | A | * | 3/1970 | Adams | 220/271 |
| 4,205,760 | A | | 6/1980 | Hasegawa | |
| 4,247,014 | A | * | 1/1981 | Walz | 220/269 |
| 4,276,993 | A | * | 7/1981 | Hasegawa | 220/269 |
| 4,465,204 | A | | 8/1984 | Kaminski et al. | |
| D289,017 | S | * | 3/1987 | Spangler et al. | D9/438 |
| D296,990 | S | | 8/1988 | Juty | |
| 4,994,009 | A | | 2/1991 | McEldowney | |
| D332,402 | S | | 1/1993 | Harwood et al. | |
| D390,463 | S | | 2/1998 | Harrold et al. | |
| 5,738,237 | A | | 4/1998 | McEldowney | |
| D415,425 | S | * | 10/1999 | Turner et al. | D9/438 |
| 5,967,726 | A | | 10/1999 | Turner et al. | |
| D419,873 | S | | 2/2000 | Piccione | |
| 6,026,971 | A | * | 2/2000 | Lundgren | 220/269 |
| 6,575,325 | B2 | * | 6/2003 | Dickie et al. | 220/269 |
| 6,951,293 | B2 | * | 10/2005 | Thibaut | 220/268 |
| 2002/0125251 | A1 | * | 9/2002 | Dickie et al. | 220/269 |
| 2003/0132230 | A1 | * | 7/2003 | Gitelman et al. | 220/269 |
| 2005/0006388 | A1 | * | 1/2005 | Turner et al. | 220/269 |

(Continued)

FOREIGN PATENT DOCUMENTS

| | | |
|---|---|---|
| EP | 0 945 355 A2 | 9/1999 |

(Continued)

*Primary Examiner*—Anthony Stashick
*Assistant Examiner*—Christopher B McKinley
(74) *Attorney, Agent, or Firm*—Eckert Seamans Cherin & Mellott, LLC; Grant E. Coffield, Esq.

(57) ABSTRACT

The present invention generally relates to a flexible tab used to open beer/beverage can ends and food can ends. The tab has a plurality of slots provided in about a middle part of the tab between a nose portion and a lift portion on opposing sides of the tab. The slots combine to form a fulcrum that extends generally transverse to an axis that passes along a length of the tab. The fulcrum allows the lift portion to pivot upwards and downwards in relation to the nose portion. The tab also has a paneled or beaded area adjacent to the slots at about the middle part of the tab. Tooling for the manufacture of the flexible tab is also provided. A method for manufacturing the flexible tab is additionally provided as well.

9 Claims, 5 Drawing Sheets

U.S. PATENT DOCUMENTS

| | | | | |
|---|---|---|---|---|
| 2005/0039314 | A1 | 2/2005 | Dickie et al. | |
| 2006/0096994 | A1 * | 5/2006 | Turner et al. | 220/619 |

FOREIGN PATENT DOCUMENTS

| | | | |
|---|---|---|---|
| JP | 2000-128167 | | 5/2000 |
| JP | 200128167 | | 5/2000 |
| JP | 2003-128062 | | 5/2003 |
| WO | WO 01/28875 | A1 | 4/2001 |

* cited by examiner

FLEXIBLE TAB, TOOLING FOR THE MANUFACTURE OF THE FLEXIBLE TAB AND METHOD OF MANUFACTURING THE FLEXIBLE TAB

FIELD OF THE INVENTION

The present invention generally relates to a flexible tab used to open beer/beverage can ends and food can ends, tooling for the manufacture of the flexible tab and a method of manufacturing the flexible tab.

BACKGROUND OF THE INVENTION

A tab is typically secured to a can end and the can end is opened by lifting a lift portion of the tab by pulling upwards on the tab so as to pivot the tab about a rivet which secures the tab to the can end. Lifting the lift portion of the tab upwards fractures a score line disposed on the can end which permits the end-user to access the contents of the can end.

Oftentimes, the prior art tab is a rigid member wherein the rigidity of the tab does not enable easy opening of the can end with the tab. Prior to use, the tab is generally in a flat orientation, parallel to the plane of the end panel of the can end. Lifting the tab requires the end-user to reach with their finger between the tab and the seam of a can end to exert upward lift on the bottom side of the tab. Such an approach can create difficulty for the end-user to acquire proper leverage to open the can end. The difficulty can become more pronounced if the end-user has long fingernails or weak fingers that make it awkward for the end-user to reach between the tab and the seam of the can end.

Several patents have attempted to overcome this issue by having a flexible portion within the tab. Such an approach enables the end-user to initially pivot a lift portion of the tab upwards about the flexible portion without initially pivoting the tab about the rivet and incurring resistance from the can end. Once the tab is bent in this manner, the end-user can gain full leverage on the tab to pivot the tab along the rivet that stakes the tab to the can end and sever the score line on the can end without being encumbered by the close confinement of the end panel or the seam.

U.S. Pat. No. 6,026,971 to Lundgren discloses a pull tab with a flexible portion, wherein the flexible portion transects the pull tab, dividing it into a nose portion and a lift portion. The upward bending of the pull tab about the flexible portion enables a user to gain leverage when opening a can end by first bending the lift portion upward while the nose portion remains still. The flexible portion, however, completely extends from one side of the pull tab to the other, creating a full line of demarcation. Pull tabs with full lines of demarcation tend to break off during initial upward lift of the lift portion or during pushing of the lift portion downward after use.

U.S. Pat. No. 6,575,325 to Dickie et al. discloses a pull tab opener with a nose portion and a lift portion separated by a flexible crease line, where the lift portion is articuable in relation to the nose portion. The nose and lift portion are connected by at least a pair of angular, hinge-like protrusions upstanding from the pull tab. The protrusions help keep the pull tab from breaking off along the crease line when the pull tab is lifted upward to open a can end; however, pushing of the pull tab downward runs the risk of breaking off the lift portion since the crease line is not reinforced to effectively permit flexible downward movement of the pull tab about the crease line. Also, the protrusions are difficult to manufacture and would substantially increase the cost of manufacture of the pull tab both in the amount of material used and in the equipment necessary to form the pull tabs. Additionally, the protrusions could interfere with the bottom of the dome of a can where the cans are vertically stacked on top of each another in storage. If the protrusions are too high, it would be difficult to stack cans having such a can end seamed thereon leading to storage problems with this can end.

U.S. Pat. No. 3,499,573 to Adams discloses an opening system for removing an entire end panel of a container. The opening system includes a pull tab having notches on opposed sides of the pull tab, wherein the notches allow the pull tab to bend upward, enabling the user to get enough leverage to open the can and remove the end panel. The pull tab requires two rivets, however, surrounded by a mustache shaped score line on the product side of the can end, wherein the lifting of the pull tab severs a connection between one of the rivets and the pull tab. Further, a central area of the pull tab extends around the rivets. The solid nature of the tab and the extra rivets result in unnecessary resistance when opening the tab. Further, the excess material used to form the tab increases the cost of manufacturing the product.

There continues to be a need in the art for a tab that enables an end-user to bend the tab upward about a fulcrum with minimal resistance in order to gain leverage to sever a score line in a can end, and to thereafter push the tab downward back to a substantially flat position above the end panel without breaking off the lift portion.

SUMMARY OF THE INVENTION

It is an object of the present invention to provide a tab that has a fulcrum wherein the fulcrum enables a lift portion to bend upwardly along the fulcrum upon upward lift of the lift portion of the tab and allows the lift portion to bend downwardly along the fulcrum after a score line is severed in a can end without the lift portion breaking off from the tab.

The object of the present invention is obtained by providing a flexible tab to be affixed to a can end. The tab has a nose portion located at a front end of the tab and a lift portion located at a back end of the tab. The back end of the tab has an outer surface at a preselected height, the nose portion and the lift portion have curled or hemmed edges and the tab has a preselected length. An axis passes along the length of the tab and a plurality of slots are provided in about a middle part of the tab between the nose portion and the lift portion on opposing sides of the tab. The slots combine to form a first fulcrum that extends generally transverse to the axis with the fulcrum allowing the lift portion to pivot upwards and downwards in relation to the nose portion. A rivet receiving portion is located rearwardly of the nose portion which has a rivet hole. The rivet receiving portion is integrally attached to the nose portion. A slot having opposed ends is located adjacent to the rivet hole surrounding a portion of an outer periphery of the rivet hole and an outer periphery of the rivet receiving portion with the ends of the slot defining a second fulcrum that extends generally transverse to the axis allowing the tab to pivot upwards and downwards about the fulcrum. A paneled or beaded area is located in front of the outer surface of the lift portion at a height lower than the outer surface and adjacent to the slots which are located in about the middle part of the tab. The paneled or beaded area has a first edge adjacent to the outer surface of the lift portion and in front of the outer surface of the lift portion, the first edge extending in a direction generally transverse to the axis with the first edge having opposite ends. The opposite ends of the first edge have a second edge or a third edge attached to one of the opposite ends. The second edge and the third edge are located in opposed relationship to each other and lie generally in the direction of the axis with the second and third edges terminating at a juncture with the slot with the second and third edges at the juncture with the slot being integrally connected to each other through a fourth edge. The object of the present invention is also obtained by providing tooling for the manufacture of a flexible tab to be affixed to a can end previously described.

The object of the present invention is additionally obtained by providing a method of manufacturing a flexible tab to be affixed to a can end. The method comprises: lancing, piercing or cutting slots in about a middle portion of material in a direction generally transverse to an axis that passes along a length of the material; curling the material about a periphery of the material; and paneling or beading the material in front of an outer surface having a preselected height of a lift portion located at a back end of the tab at a height lower than the outer surface and adjacent to the slots which is located in about a middle part of the tab. The paneled or beaded area has a first edge adjacent to the outer surface of the lift portion and in front of the outer surface of the lift portion, the first edge extending in a direction generally transverse to the axis with the first edge having opposite ends. The opposite ends of the first edge have a second edge or a third edge attached to one of the opposite ends. The second edge and the third edge are located in opposed relationship to each other and lie generally in the direction of the axis with the second and third edges terminating at a juncture with a slot with the second and third edges at the juncture with the slot being integrally connected to each other through a fourth edge.

The object of the invention will be more fully understood from the following detailed description of the invention with reference to the FIGS. appended hereto.

DETAILED DESCRIPTION OF THE PREFERRED EMBODIMENTS

Figure 1:
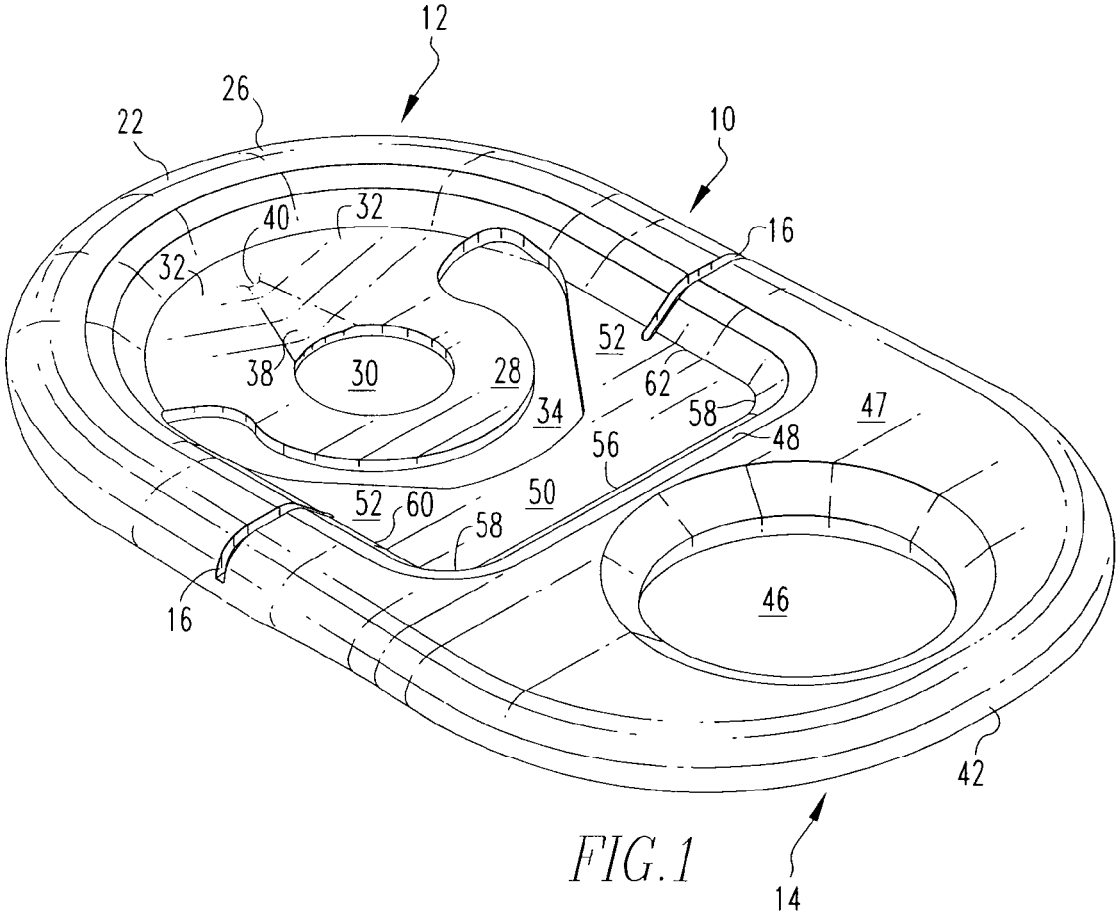
FIG. 1 is an isometric view of a tab of the present invention.
Figure 2:
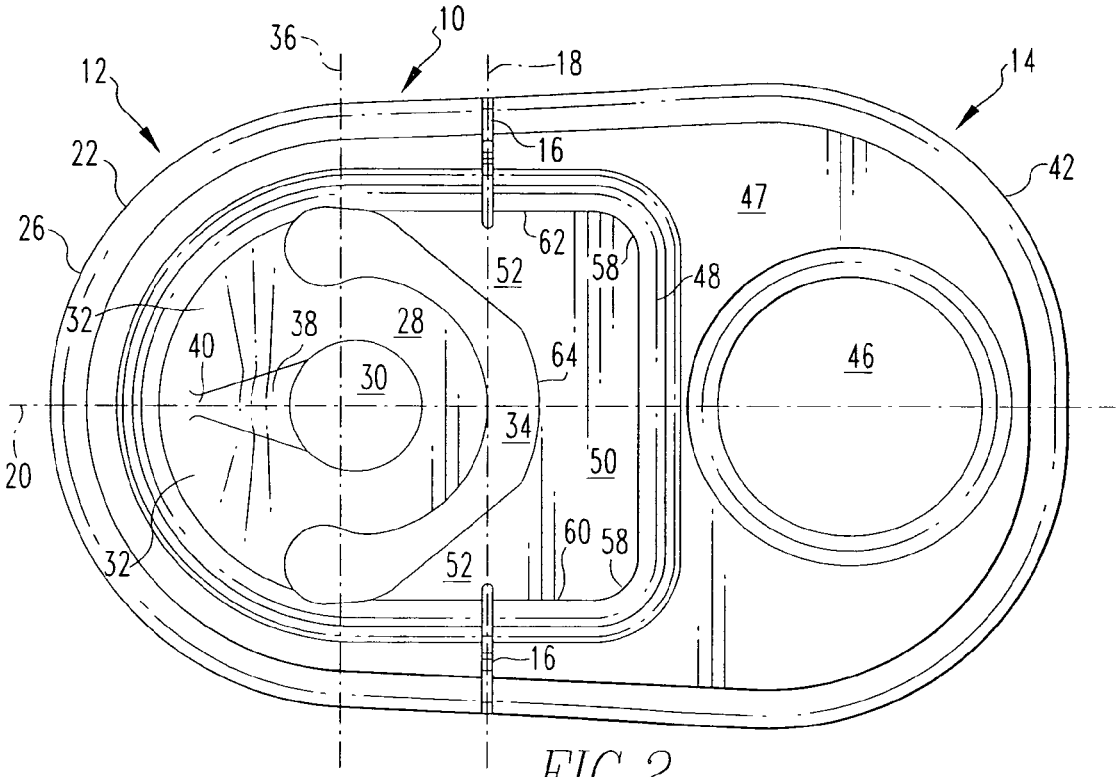
FIG. 2 is a top plan view of the tab of the present invention.
Figure 3:
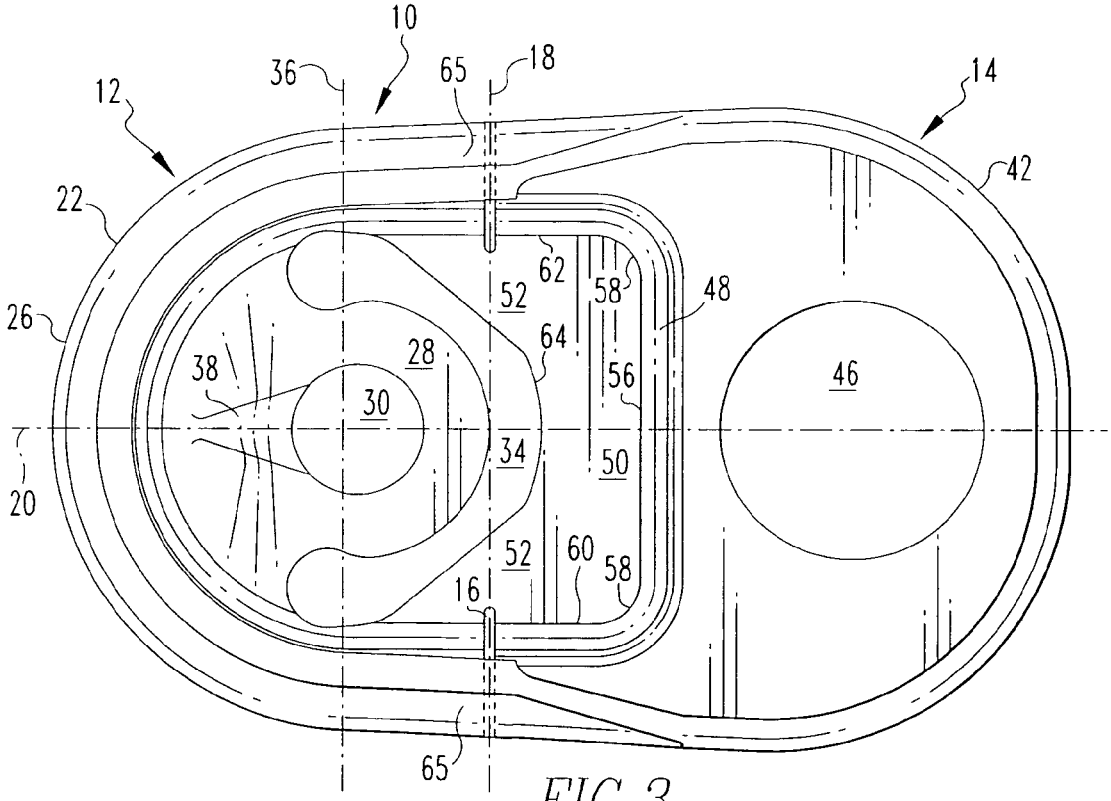
FIG. 3 is a bottom plan view of the tab of the present invention.
Figure 4:
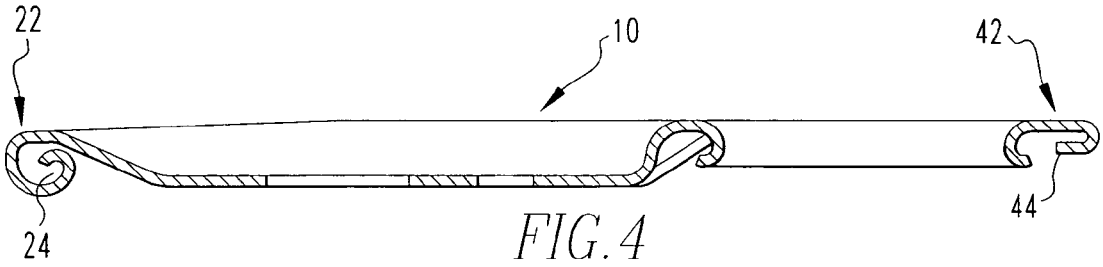
FIG. 4 is a side cross-sectional view of the tab of the present invention.

For purposes of the description hereinafter, the terms "upper", "lower", "vertical", "horizontal", "top", "bottom", "aft", "behind", and derivatives thereof shall relate to the invention, as it is oriented in the drawing FIGS. However, it is to be understood that the invention may assume various alternative configurations except where expressly specified to the contrary. It is also to be understood that the specific elements illustrated in the drawings and described in the following specification are simply exemplary embodiments of the invention. Therefore, specific dimensions, orientations and other physical characteristics related to the embodiments disclosed herein are not to be considered limiting.

As employed herein, the term "number" refers to one or more than one (i.e., a plurality). As employed herein, the term "fastener" refers to any suitable fastening, connecting or tightening mechanism expressly including, but not limited to, integral rivets. As employed herein, the statement that two or more parts are "coupled", "attached" or "connected" together shall mean that the parts are joined together either directly or joined through one ore more intermediate parts.

Turning to FIGS. 1-4, a tab 10 of the present invention is shown. Tab 10 includes a nose portion 12 at the front end of tab 10 and a lift portion 14 at the back end of tab 10, wherein each portion is preferably U-shaped along its periphery such that the two portions compliment each other to form the generally oval shaped tab 10. A first and second slot 16 are provided in about the middle part of the tab 10 between the nose portion 12 and the lift portion 14 on opposing sides of the tab 10, the two slots 16 combining to form a first fulcrum 18 that extends generally transverse to an axis 20 that passes through the length of the tab 10 which is of a preselected length and divides the tab 10 in half with each half being a mirror image of the other half. The fulcrum 18 allows the lift portion 14 to pivot upwards and downwards in relation to the nose portion 12. The fulcrum 18 has the benefit of enabling an end-user to easily lift the tab 10 when it is affixed to a can end. Such an easy lift tab is particularly useful for: (i) younger children and (ii) people with arthritis that have difficulty in opening the longitudinally rigid tabs of the prior art. Additionally, the fulcrum 18 allows any end-user to more easily lift the tab 10 to access the contents of a can.

Nose portion 12 includes first curled edges or hemmed edges 22 along a periphery of the nose portion 12, wherein the edges 22 are curled underneath the nose portion 12 to form, a cylindrical cross-section shaped curl or edge portion 24 to rigidize the nose portion 12 and provide beam strength to the nose portion 12, thereby increasing the strength of the tab 10. Alternatively, the edge portion 24 is hemmed. The first curled edges 22 extend around the outer U-shaped periphery of the nose portion 12. The front 26 of the nose portion 12 may be more significantly rolled to significantly increase the area of the nose portion 12 that contacts a tear panel of a can end or a removable center panel of a can end.

A rivet receiving portion 28 is a compressed, generally semi-circular shaped, square shaped or rectangular shaped panel located rearwardly of the nose portion 12 with a central rivet hole 30. The rivet hole 30 is shaped to receive an integral rivet to affix the tab 10 to a can end about which the nose portion 12 can pivot. The rivet receiving portion 28 is integrally attached to the nose portion 12 along one or a multiplicity of indentations 32. The indentations 32 enable flexibility about the rivet when the nose portion 12 is actuated. C-shaped slot 34 surrounds a portion of the outer periphery of rivet hole 30 and the outer periphery of the rivet receiving portion. The C-shaped slot 34 is a void that further facilitates flexibility of the tab 10 with the opposed ends of the C-shaped slot 34 defining a second fulcrum 36 that extends generally transverse to the axis 20. The fulcrum 36 allows the tab 10 to pivot upwards and downwards about the fulcrum 36.

V-shaped coin 38 is provided between the rivet hole 30 and front 26 adjacent to the indentations 32, and is generally of a similar thickness as the rivet receiving portion 28. The V-shaped coin 38 rigidifies the first curled edge 22, and prevents tearing of the tab 10 during the stress of opening a can end. A sloped trough 40 adjacent to indentations 32 may connect front 26 to V-shaped coin 38.

Lift portion 14 is the part of the tab 10 actuated by an end-user to open a can end. The lift portion 14 is generally U-shaped with second curled edges or hemmed edges 42 along a periphery of the lift portion 14. The second curled edges 42 are curled or hemmed underneath the lift portion 14 to form a hemmed shaped curl or edge portion 44. Alternatively, edge portion 44 has a cylindrical curl. The lift portion 14 includes a finger hole 46 disposed through an outer surface 47 of the lift portion 14 for user activation. The outer surface 47 has a preselected height. While the finger hole 46 is shown as having the shape of a circle, one of skill in the art would appreciate that finger hole 46 could be in the shape of an oval, ellipse or other geometric shapes. In front of the finger hole 46 and outer surface 47, tapered portion 48 extends downward to a paneled or beaded area 50 at a lower height or plane in relation to the outer surface 47 of the lift portion 14, wherein paneled area 50 is a compressed area adjacent and integral to the lift portion 14 which is located about in the middle of the tab 10 adjacent to slots 16 and in front of the outer surface 47. In alternate embodiments, in front of the finger hole 46 and outer surface 47, an abrupt wall portion may extend downward to the paneled area 50.

Paneled area 50 further comprises extensions 52 that extend generally in the direction of the axis 20 toward the nose portion 12. Extensions 52 are integrally connected to the nose portion 12 by the first curled edge 22, thereby integrally attaching the nose portion 12 and the lift portion 14 through the middle of the tab 10. The paneled or beaded area 50 provides the middle of the tab 10 with increased strength and rigidity such that the lift portion 14 does not disconnect from the tab 10 after upward movement or downward movement of the lift portion 14 about the fulcrum 18.

The first and second slots 16 are provided between the nose portion 12 and the lift portion 14 in about the middle of the tab 10, the two slots 16 combining to form the first fulcrum 18 along which the lift portion 14 can pivot upwards and downwards in relation to the nose portion 12. Slots 16 are on opposing sides of the tab 10 and extend from the periphery of the tab 10 toward paneled or beaded 50 in a direction generally transverse to the axis 20.

In certain embodiments, the slots 16 do not extend all the way to the paneled area 50. Instead, a small connector (not shown) is provided between the paneled area 50 and the inward edges of the slots 16. The connector is integrally connected to the nose portion 12 and the lift portion 14, providing strength to the tab 10 during the stress of upward movement of the lift portion 14 about fulcrum 18 when an end-user actuates the lift portion 14 to open a can end and the downward movement of the lift portion 14 about fulcrum 18 when the lift portion 14 is pushed downward by the end-user.

In certain embodiments, the paneled or beaded area 50 has a first edge 56 connected to the tapered portion 48 adjacent to the finger hole 46. First edge 56 extends generally transverse to axis 20. Each of the opposite ends 58 of the first edge 56 have a second edge 60 or a third edge 62 attached to the opposite ends 58 of the first edge 56 wherein the second edge 60 and the third edge 62 are in opposed relationship to each other and generally lie in the direction of axis 20. Second edge 60 and third edge 62 terminate at the juncture with the C-shaped slot 34. The end points of the second edge 60 and the third edge 62 at the juncture with the C-shaped slot are integrally connected to each other through a fourth edge 64 of the tab 10 to define the paneled or beaded area 50. The fourth edge 64 may be comprised of: (i) a smoothly flowing arc without any points of intersection in the arc wherein the arc may have a general U-shape; (ii) linear portions connected to curved portions such that the fourth edge 64 does not look like a smooth arc; or (iii) other configurations.

In certain embodiments, the curled edges 22, 42 that curl underneath the periphery of both the nose portion 12 and the lift portion 14 have portions that connect beneath slots 16, thereby further integrally connecting the nose portion 12 and the lift portion 14. Thus, in certain embodiments, slots 16 do not extend completely through a depth of the periphery of the tab 10 so the curled edges beneath the slots 16 are not cut. The curled edges of the nose portion 12 and the lift portion 14 and the curled edged beneath slots 16 together form a continuous curl 65 around a portion of the periphery of the tab 10. See, FIG. 3. The continuous curl portion 65 improves the strength of the tab 10 during the lifting of the lift portion 14 upward about fulcrum 18 and the resetting of the lift portion 14 downward about fulcrum 18, thereby holding the nose portion 12 and the lift portion 14 together during use.

Figure 5:
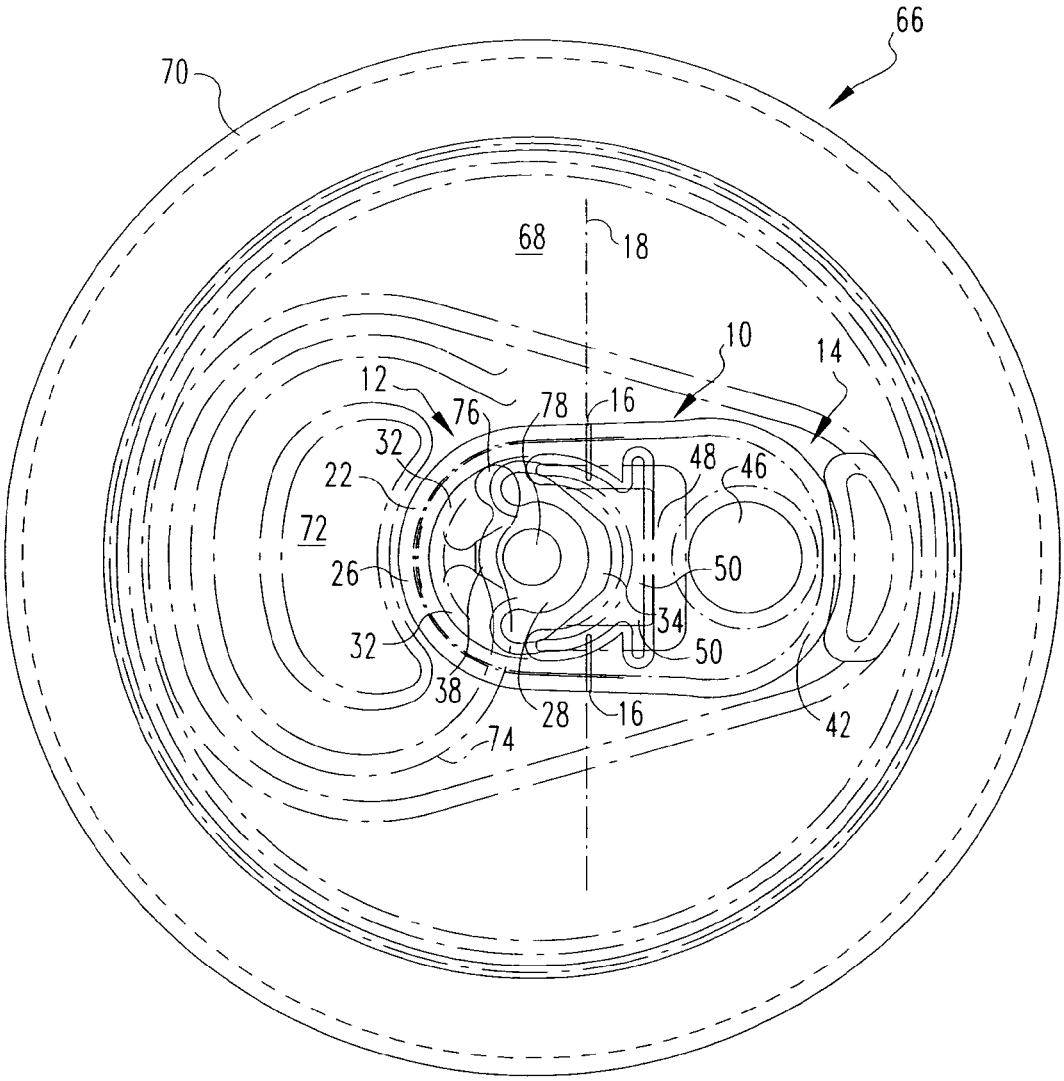
FIG. 5 is a top plan view of the tab of the present invention affixed to a beer/beverage can end.

Turning to FIG. 5, the tab 10 of the present invention is shown affixed to a standard can end 66 used in beer/beverage applications. Can end 66 has an end panel 68 of generally circular shape which includes a circumferentially extending raised curl 70 for attaching the can end 66 to a suitable beer/beverage can (not shown) or the like. In general, the can end 66 will be manufactured of a relatively ductile metal such as, for example, aluminum, but it may be made from other acceptable materials as required, such as, for example, steel.

A retained tear panel 72 extends across can end 66 from a position spaced inwardly of raised curl 70 to approximately the center of can end 66. Tear panel 72 is defined by a generally U-shaped score line 74 with open end 76 of the U-shaped score line 74 positioned toward the center of can end 66. Score line 74 is interrupted so that tear panel 72 will be captively retained on the underside or product side of can end 66 when torn open. An integral rivet 78 is positioned adjacent open end 76 of U-shaped score line 74 and on the opposite side of the score line from the tear panel 72 is the lift portion 14 of the tab 10 of the present invention which is secured to the can end 66 with rivet 78.

Figure 6:
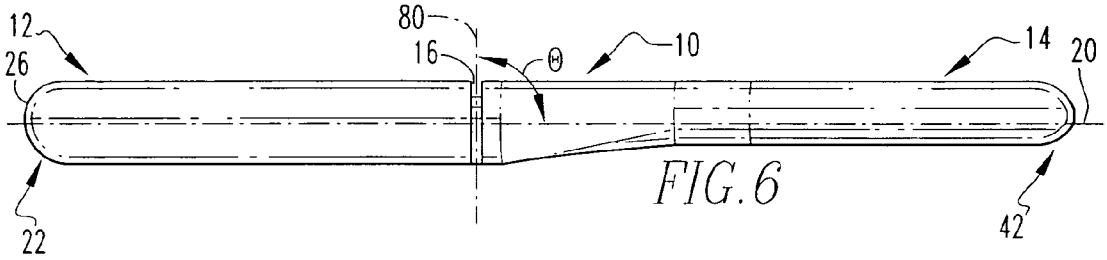
FIG. 6 is a side view of the tab of the present invention.

Turning to FIG. 6, an upwardly extending axis 80 is shown extending from the slots 16 which forms an angle θ with the axis 20 that extends along the length of the tab 10. In certain embodiments, θ will have a value of about 90°. As can be appreciated, in other embodiments of the invention, θ may have a value from about 80° to about 100°. When lift portion 14 is raised upwards about fulcrum 18, lift portion 14 bends upward along the fulcrum 18, enabling the end-user to obtain proper leverage and more easily lift the lift portion 14 to open a can end. The lift portion 14 bends upward about fulcrum 18 by a preselected angle of about less than 45° or about less than 30° while the nose portion 12 remains still or continues to lie along axis 20. The angle that the lift portion 14 bends upward is defined by the angle formed between a line extending through the length of the lift portion 14 and axis 20. The amount of upward lift of the lift portion 14 is dependent upon the specific configuration of the slots 16 used on the tab 10. During the initial upward lift or movement of lift portion 14, the nose portion 12 remains at an angle of about 0° which angle is defined by the angle formed between a line extending through the length of the nose portion 12 and axis 20. At sufficient upward lift of the lift portion 14 about fulcrum 18, the slots 16 are sufficiently closed at a preselected angle of about less than 45° or about less than 30° which angle is defined by the angle formed between a line extending through the length of the lift portion 14 and axis 20. At this point, the lift portion 14 can no longer move upward without causing tension to be translated to the nose portion 12 through the closed slots 16. As the lift portion 14 is lifted upward past this point, the rivet 78 onto which the tab 10 is staked is bent forwardly toward the tear panel 72. The movement of the rivet 78 toward the tear panel 72 causes an initial rupture of the score line 74 proximate the rivet 78. As the tab 10 is actuated, it functions like a lever and causes the nose portion 12 to pivot toward the tear panel 72.

At this point, further upward movement of the lift portion 14 will induce downward movement in the nose portion 12 wherein the nose portion 12 pivots about rivet 78. The nose portion 12 thereafter initiates a tear along score line 74, causing tear panel 72 to bend downwardly. As the lift portion 14 is raised further, the score line 74 is caused to tear and a portion of the tear panel 72 remains secured to the can end 66. Accordingly, the tear panel 72 is captivity retained on the underside or product side of the can end 66. When the lift portion 14 has been raised so the tear panel 72 is sufficiently open, the lift portion 14 may be bent downward about the fulcrum 18 and reset so as to lie substantially flush against the outer surface of the end panel 68 of the can end 66. This flexibility of the lift portion 14 permits the lift portion 14 to not interfere with an end-user consuming the contents of the opened can end 66. Paneled or beaded area 50 and continuous curl 65 around a portion of the periphery of the tab 10 ensure that the lift portion 14 does not break off from the nose portion 12 during upward movement of the lift portion 14 about fulcrum 18 or during downward movement of the lift portion 14 about fulcrum 18. Prior art tabs that only use slots for enabling upward and downward lift about a fulcrum suffer from the limitation of having the lift portion break off from the tab because the fulcrum was not reinforced with a paneled or beaded area adjacent to the fulcrum or a continuous curl about a portion of the periphery of the tab.

While the disclosure of FIG. 5 and the specification associated therewith is directed to a can end for beer/beverage applications for the purpose of drinking a liquid or pouring a liquid into another container directly from the can, the tab 10 of the present invention can also be applied to other types of can ends that have the entire end panel removed such as, for example, food can ends. One of ordinary skill in the art would readily appreciate that the teachings of the present invention would equally apply to can ends used in beer/beverage applications as well as in food applications. As such, the tab 10 of the present invention encompasses tabs that are affixed to beer/beverage can ends, food can ends and other can ends. It is noted that the details of the tab 10 of the present invention affixed to other can ends has been omitted for the purpose of simplifying the specification and FIGS. of the present invention.

In the tooling for the manufacture of the tab 10 of the present invention and associated method, material to be converted into a plurality of tabs 10 is conveyed into a conversion press. In the typical operation of a conversion press, material is introduced between at least one upper tool member and at least one lower tool member that are in an open, spaced apart position. A ram advances the upper tool member toward a lower tool member in order to perform any of a variety of tooling operations such as rivet forming, hole punching, scoring, paneling, embossing and/or final staking. After performing an operation at a specific station, the press ram retracts until the upper tool member and lower tool member are once again in the open, spaced apart position. The partially converted material is transported to the next tooling station until the tab 10 is completely formed and discharged from the conversion press. As the material leaves a given tooling operation, more material is introduced to the vacated operation, for example, as part of a continuous sheet, thus continuously repeating the manufacturing process.

Figure 7:
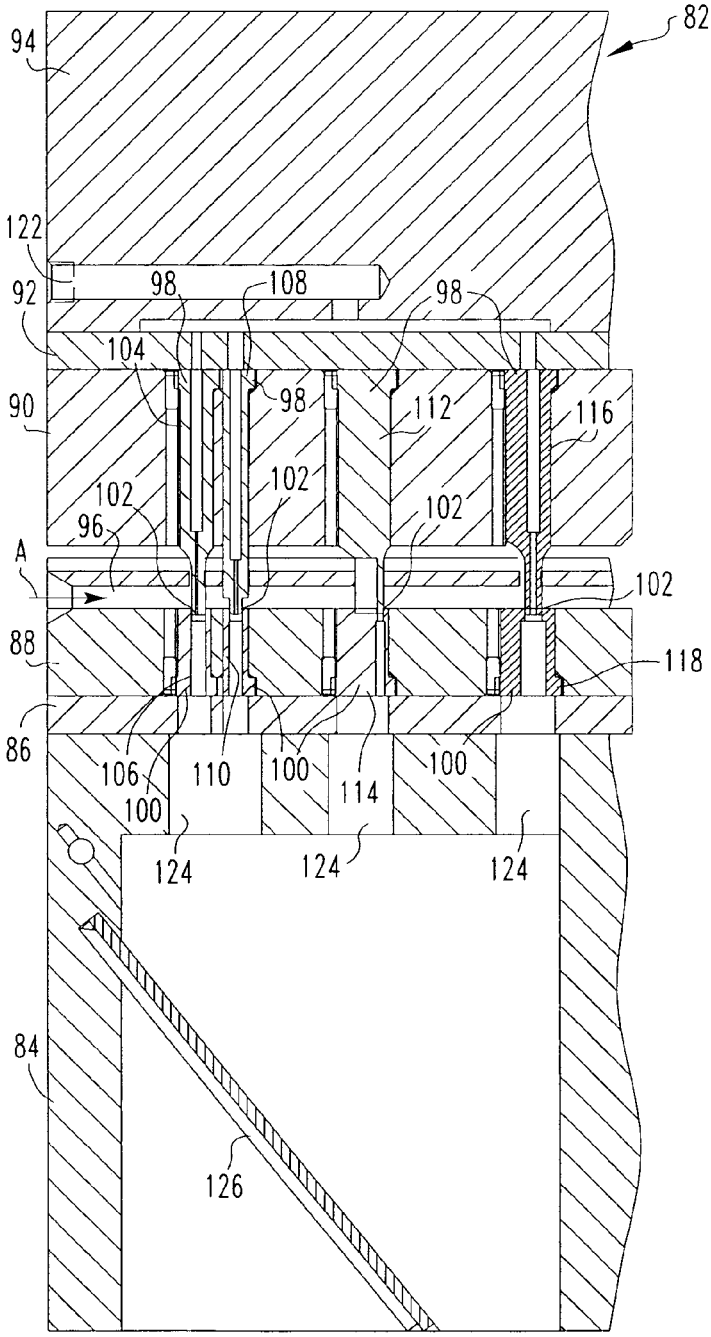
FIG. 7 is a cross-sectional view of a piercing station.
Figure 8:
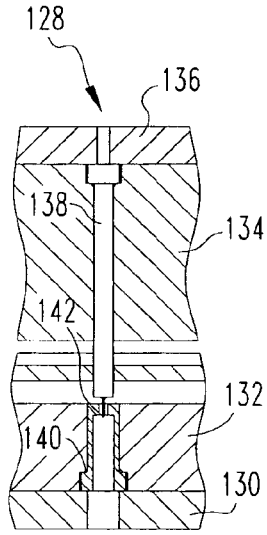
FIG. 8 is a cross-sectional view of another piercing station.
Figure 9:
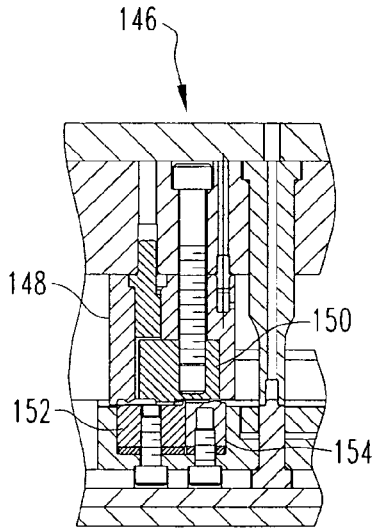
FIG. 9 is a cross-sectional view of a paneling and reform station.

A method for forming the tab 10 of the present invention is shown in FIGS. 7-11. As depicted in FIGS. 7-9, material is moved through a plurality of stations until the tab 10 of the present invention is formed by lancing, piercing or cutting the material with first and second slots with one or more tools in a direction generally transverse to an axis that passes along the length of the material being formed, curling the material about a periphery of the material with one or more tools so the lanced slots appear like slots 16 of the tab 10 and paneling or beading the material with one or more tools adjacent to slots 16 to form paneled or beaded area 50 of the tab 10.

Each station includes one or more tools, wherein each of the tools perform a tooling operation on the material. Note that while a limited number of stations are included in the FIGS., the method of manufacturing the tab 10 of the present invention can include numerous other stations not depicted here which are known in the art. Further, each of the stations can be housed in separate machine housings, in a single machine housing, or any combination thereof.

The material can be conveyed through the conversion press by any means known in the art. Typically, material is fed into the conversion press as sheets or is uncurled first and then fed into the conversion press in sheets which is conveyed through the stations as a solid sheet until enough tooling operations have been performed on the material that separate tabs 10 are formed. Further, the material that manufactures tabs 10 is a relatively ductile metal such as, for example, aluminum, but it may be made from other acceptable materials as required, such as, for example, steel.

In FIG. 7, a partial cross section of a first piercing station 82 is shown. First piercing station 82 includes, from bottom to top, lower die shoe 84, lower die plate 86, die retainer 88, punch retainer 90, upper punch plate 92 and upper die shoe 94. Lower die shoe 84, lower die plate 86 and die retainer 88 are stationary and are preferably secured to a base of the conversion press. Punch retainer 90, upper punch plate 92 and upper die shoe 94 (collectively, the "upper tools") are moveable in a plane, generally in an axial upward and downward direction. The upper tools could be moved with any apparatus known in the art. Typically, this is done with a press ram attached to the upper die shoe 94, wherein the ram is secured within a larger housing that surrounds the conversion press. Thus, as the ram moves up and down, the upper tools correspondingly move in an axial direction up and down. The movements of the ram can be controlled with a computer programmable logic control device or other means known in the art.

Within the retainers 88, 90, four sets of complimentary tooling members are shown in FIG. 7 that lance, pierce or cut a sheet of material as it is transported through an opening 96 of first piercing station 82 along path A. Each of the four sets of tooling members includes an upper punch 98 movable in an axial direction upwards and downwards and a corresponding die 100 that has a hole in the die 100 with a size that accommodates the sharpened edges 102 located on the lower surface of the upper punches 98 in a slight clearance or clearance relationship. The die 100 also has sharpened edges about an upper surface of the die 100 adjacent to the outer periphery of the hole. The upper punches 98 are urged in an axial direction up and down by the movements of the upper tools coupled to the ram of the conversion press. The sharpened edges 102 of the upper punches 98 lance, pierce or cut the material in cooperation with the sharpened edges of the upper surface of the die 100 by extending into the dies 100.

The material is lanced, pierced or cut by the upper punches 98 as they are urged in an axial direction downwards by the upper tools. The four pierce stations within pierce station 82 are triangle punch 104 and complimentary triangle die 106, rivet hole punch 108 and complimentary rivet hole die 110, tongue punch 112 and complimentary tongue die 114, and finger hole punch 116 and complimentary finger hole die 118.

Figure 10:
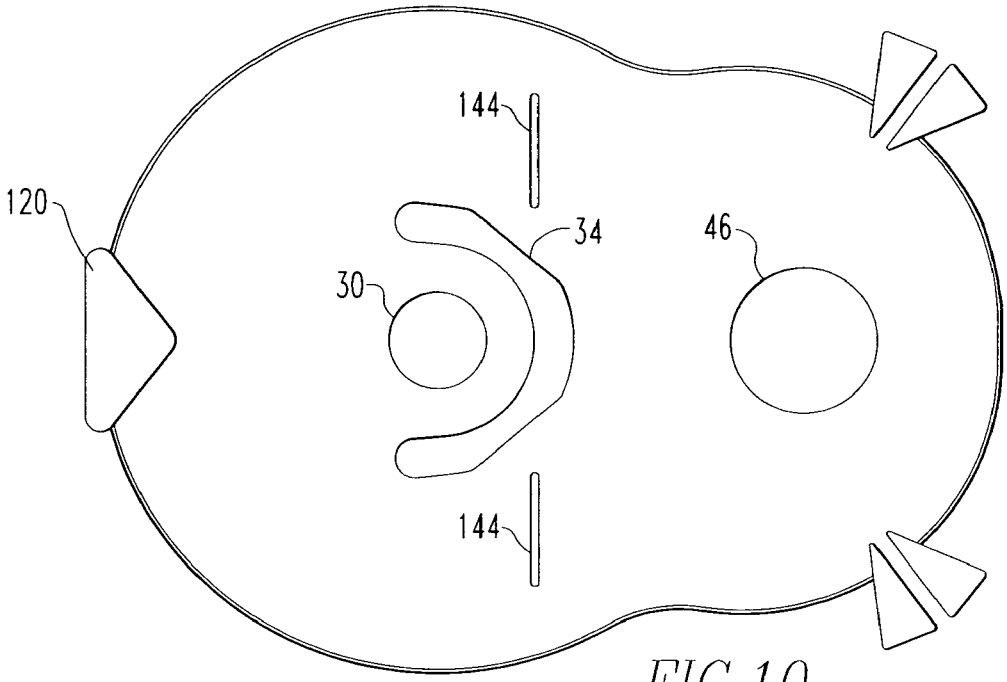
FIG. 10 is a top plan view of material after a variety of piercings and lancings have been performed on the material.
Figure 11:
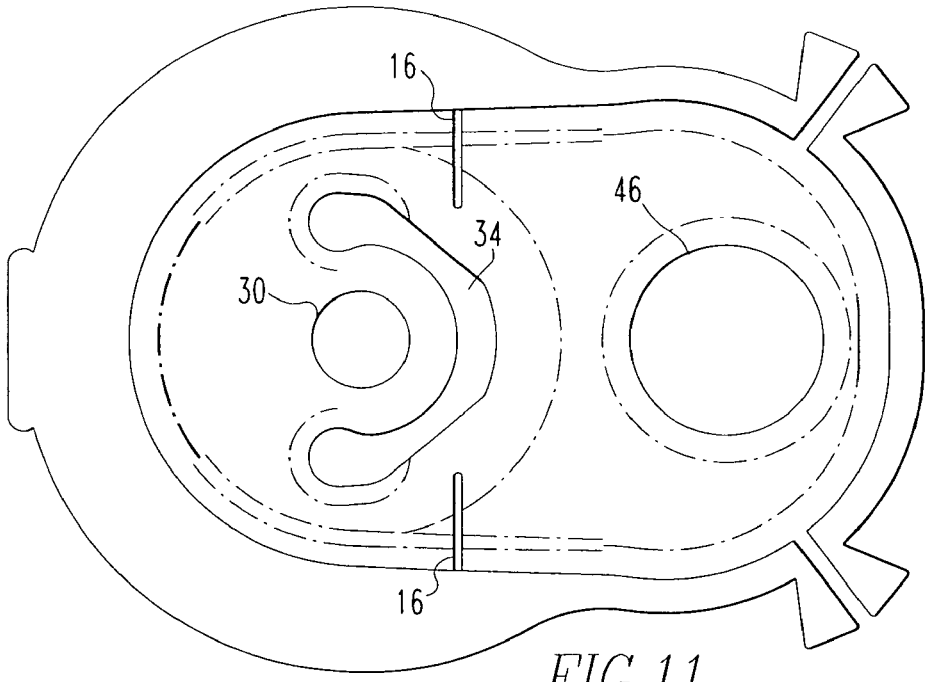
FIG. 11 is a top plan view of the material showing the tab of the present invention after the periphery has been curled.

As shown in FIG. 10, the triangle punch 104 and the complementary triangle die 106 of FIG. 7 pierce, lance or cut a triangular shaped hole 120 in a front area of the material. Triangle punch 104 has a triangular shaped profile at the lower surface of the triangle punch 104 and the hole of the triangle die 106 has a complementary triangular shaped hole adjacent to the upper surface of the triangle die 106. The rivet hole punch 108 and the complimentary rivet hole die 110 pierce, lance or cut rivet hole 30 in the material for receiving rivet 78. Rivet hole punch 108 has a circular or round shaped profile at the lower surface of the rivet hole punch 108 and the hole of the rivet hole die 110 has a complementary circular or round shaped hole adjacent to the upper surface of the rivet hole die 110. Tongue punch 112 and complimentary tongue die 114 pierce, lance or cut C-shaped slot 34 in the material. Tongue punch 112 has a C-shaped profile at the lower surface of the tongue punch 112 and the hole of the tongue die 114 has a complementary C-shaped hole adjacent to the upper surface of the tongue die 114. Finger hole punch 116 and complementary finger hole die 118 pierce, lance or cut a finger hole 46 in the material. Finger hole punch 116 has a circular, oval or elliptical shaped profile at the lower surface of the finger hole punch 116 and the hole of the finger hole die 118 has a complementary circular, oval or elliptical shaped hole adjacent to the upper surface of the finger hole die 118.

The pieces of metal that are pierced, lanced, cut or punched out of the material are preferably removed from the piercing station 82 to avoid excess build-up of metal within the pierce station 82. Gas is conveyed through a bore 122. The gas travels through openings in the upper punches 98 and blows any metal downward through openings 124 below the die 100 in the lower die plate 86 and lower die shoe 84. The metal falls to member 126 and slides to the bottom of lower die shoe 84 where the metal is expelled from the lower die shoe 84 with gas.

The material is conveyed out of the first pierce station 82 and into a second pierce station 128, shown in cross section in FIG. 8. As noted, additional pierce and/or tooling stations may be included in between, before or after the first and second pierce stations 82, 128. The second pierce station 128 includes, from bottom to top, a lower die shoe (not shown), lower die plate 130, die retainer 132, punch retainer 134, upper punch plate 136 and upper die shoe (not shown). At least one slot punch 138 is positioned within the punch retainer 134, and at least one slot die 140 is positioned beneath the slot punch 138 in the die retainer 132. Slot punch 138 is movable in an axial direction upwards and downwards and the corresponding slot die 140 has a hole in the die 140 with a size that accommodates the sharpened edges 142 located on the lower surface of the slot punch 138 in a slight clearance or clearance relationship. The die 140 also has sharpened edges about an upper surface of the die 140 adjacent to the outer periphery of the hole. Slot punch 138 is coupled to the ram of the conversion press and is urged in an axial direction up and down by the movements of the ram. The sharpened edges 142 of the slot punch 138 lance, pierce or cut the material in cooperation with the sharpened edges of the upper surface of the slot die 140 by extending into the slot dies 140, thereby forming slots 144 in about the middle part of the material in a direction generally transverse to an axis that passes through the length of the material being formed. The second pierce station 128 preferably has two slot punches 138 and two slot dies 140 to form slots 144 as shown in FIG. 10. Once the slots 144 are formed, the periphery of the material is curled to yield the resultant partially manufactured tab shown in FIG. 11.

The material is further conveyed to a tab reform station 146 wherein the paneled or beaded area 50 is formed within the material as shown in FIG. 9. This station 146 includes upper toolings and lower toolings with operative male and female tooling components, such that the upper toolings are movable downward in an axial direction and compress the material between the upper and lower toolings, thereby forming a compressed area adjacent to the slots 16 that is paneled or beaded area 50. The upper toolings include a punch tab 148, an upper insert 150 and the lower toolings include a die reform 152 and lower insert 154. Typically, the upper insert 150 includes a lower surface having a projection with a first edge extending in a direction generally transverse to an axis passing through the length of the material being formed. Each of the opposite ends of the first edge have a second edge or a third edge attached to the opposite ends of the first edge wherein the second edge and the third edge are in opposed relationship to each other and generally lie in the direction of the axis. The end points of the second edge and the third edge are integrally connected to each other through a fourth edge to define the profile of the projection. The fourth edge may be comprised of: (i) a smoothly flowing arc without any points of intersection in the arc wherein the arc may have a general U-shape; (ii) linear portions connected to curved portions such that the fourth edge does not look like a smooth arc; or (iii) other configurations. Typically, the die reform 152 includes an upper surface having a recess with a complementary shape to the projection of the upper toolings. The recess has a first edge extending in a direction generally transverse to an axis passing through the length of the material being formed. Each of the opposite ends of the first edge have a second edge or a third edge attached to the opposite ends of the first edge wherein the second edge and the third edge are in opposed relationship to each other and generally lie in the direction of the axis. The end points of the second edge and the third edge are integrally connected to each other through a fourth edge to define the profile of the recess. The fourth edge may be comprised of: (i) a smoothly flowing arc without any points of intersection in the arc wherein the arc may have a general U-shape; (ii) linear portions connected to curved portions such that the fourth edge does not look like a smooth arc; (iii) or other configurations. The projection of the upper toolings is movable downward in an axial direction and presses the material being formed into the complementary shaped recess of the lower toolings to form paneled or beaded area 50 adjacent to the slots 16. The projection on the upper toolings, the recess on the lower toolings and the paneled or beaded area 50 all have a complementary shape to each other.

The tooling for the manufacture of the tab 10 and associated method may include additional tooling stations and steps. Those additional tooling stations and steps have been omitted from the FIGS. and specification for the purpose of simplifying the specification and FIGS. of the present invention.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereto.

What is claimed is:

1. A flexible tab to be affixed to a can end, the tab comprising:

a nose portion located at a front end of the tab;

a lift portion located at a back end of the tab having an outer surface with a preselected height, the nose portion having curled or hemmed edges and the tab having a preselected length;

an axis that passes along the length of the tab;

a plurality of slots provided in the tab between the nose portion and the lift portion on opposing sides of the tab, the plurality of slots combining to form a first fulcrum that extends generally transverse to the axis, the first fulcrum allowing the lift portion to pivot in relation to the nose portion;

a rivet receiving portion located rearwardly of the nose portion with a rivet hole, the rivet receiving portion being integrally attached to the nose portion;

an additional slot having opposed ends located adjacent to the rivet hole surrounding a portion of an outer periphery of the rivet receiving portion, the ends of the additional slot defining a second fulcrum, the second fulcrum allowing the tab to pivot about the second fulcrum;

a paneled or beaded area located in front of the outer surface of the lift portion at a height lower than the outer surface and adjacent to the plurality of slots, wherein the paneled or beaded area includes a number of extensions each extending toward the nose portion of the tab between the additional slot and a corresponding one of the slots on the opposing sides of the tab, wherein each of the extensions includes a substantially straight edge which defines a substantially straight segment of the additional slot, wherein the paneled or beaded area has a first edge adjacent to the outer surface of the lift portion and in front of the outer surface of the lift portion, the first edge extending in a direction generally transverse to the axis, the first edge having opposite ends, wherein the opposite ends of the first edge have a second edge or a third edge attached to one of the opposite ends, wherein the second edge and the third edge are located in opposed relationship to each other with the second and third edges terminating at a juncture with the additional slot, and wherein the second and third edges at the juncture with the additional slot are integrally connected to each other through a fourth edge.

2. The tab of claim 1, wherein the additional slot is a C-shaped slot.

3. The tab of claim 1, further comprising a can end affixed to the tab.

4. The can end of claim 3, wherein the can end is selected from the group consisting of beer can ends, beverage can ends and food can ends.

5. The tab of claim 1, wherein the nose portion and the lift portion are connected beneath the plurality of slots by a continuous curl portion.

6. The tab of claim 1, further comprising an axis that extends upwardly from the plurality of slots which forms an angle $\theta$ of 80° to 100° with the axis that passes along the length of the tab.

7. The tab of claim 1, wherein the lift portion bends upwardly about first fulcrum by an angle of about less than 45° which angle is defined by the angle formed between a line extending through the lift portion and the axis that passes along the length of the tab.

8. The tab of claim 1, wherein the lift portion bends upwardly about first fulcrum by an angle of about less than 30° which angle is defined by the angle formed between a line extending through the lift portion and the axis that passes along the length of the tab.

9. The tab of claim 1, further comprising a finger hole located in the lift portion of the tab.

* * * * *

UNITED STATES PATENT AND TRADEMARK OFFICE

CERTIFICATE OF CORRECTION

PATENT NO. : 7,703,624 B2
APPLICATION NO. : 11/207046
DATED : April 27, 2010
INVENTOR(S) : Carl McEldowney et al.

It is certified that error appears in the above-identified patent and that said Letters Patent is hereby corrected as shown below:

Column 4, line 11, "one ore more" should read --one or more--.
Column 6, line 11, "curled edged beneath" should read --curled edges beneath--.
Column 7, line 14, "is captivity retained" should read --is captively retained--.

Signed and Sealed this

Sixteenth Day of November, 2010

David J. Kappos

David J. Kappos
*Director of the United States Patent and Trademark Office*